US009625863B1

(12) United States Patent
Katakura

(10) Patent No.: US 9,625,863 B1
(45) Date of Patent: Apr. 18, 2017

(54) IMAGE FORMING APPARATUS AND CONTROL METHOD COMPRISING HEATING MODES

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Hiroshi Katakura, Numazu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/983,978

(22) Filed: Dec. 30, 2015

(51) Int. Cl.
*G03G 15/20* (2006.01)

(52) U.S. Cl.
CPC ..... *G03G 15/205* (2013.01)

(58) Field of Classification Search
CPC ..... G03G 15/205
USPC ..... 399/70
See application file for complete search history.

(56) References Cited

U.S. PATENT DOCUMENTS

| | | | | |
|---|---|---|---|---|
| 8,918,002 | B2 * | 12/2014 | Ogasawara | G03G 15/205 399/223 |
| 9,285,731 | B1 * | 3/2016 | Katakura | G03G 15/2039 |
| 2011/0311255 | A1 * | 12/2011 | Katakura | G03G 15/2078 399/70 |
| 2012/0321335 | A1 * | 12/2012 | Fujiwara | G03G 15/2078 399/69 |
| 2014/0212160 | A1 * | 7/2014 | Fukaya | G03G 15/205 399/69 |
| 2016/0054687 | A1 | 2/2016 | Katakura | |

* cited by examiner

*Primary Examiner* — Billy Lactaoen
*Assistant Examiner* — Arlene Heredia Ocasio
(74) *Attorney, Agent, or Firm* — Amin, Turocy & Watson LLP

(57) ABSTRACT

In accordance with an embodiment, an image forming apparatus controls the heating of a fixing section in such a manner that the heating mode is switched to a second heating mode through a switching section in a case in which the temperature of a heating section is lower than a predetermined temperature, and the heating mode is switched to a first heating mode through a switching section in a case in which the temperature of the heating section is equal to or higher than the predetermined temperature.

10 Claims, 7 Drawing Sheets

IMAGE FORMING APPARATUS AND CONTROL METHOD COMPRISING HEATING MODES

FIELD

Embodiments described herein relate generally to an image forming apparatus and a control method for the image forming apparatus.

BACKGROUND

An MFP (Multifunction Peripheral) is provided with a fixing section which fixes a toner image on an image receiving medium. The MFP executes a warming-up operation for heating the fixing section when started or restored from a sleep mode. The fixing temperatures when the fixing section fixes toner images on the image receiving medium vary with the categories of toner. Further, for example, in a case of restarting the MFP, the temperature of the fixing section has already risen to a certain degree of temperature.

Thus, if same warming-up operations are executed every time the MFP is started, the temperature of the fixing section will change and will be unsuitable for fixing toner images, and unnecessary power is also consumed.

DETAILED DESCRIPTION

In accordance with an embodiment, an image forming apparatus is provided with an image forming section, a fixing section, a switching section and a control section. The image forming section forms a toner image on a medium. The fixing section is provided with a heating section and a pressurization section, and enables the medium on which the toner image is formed to pass a portion between the heating section and the pressurization section to fix the toner image on the medium. The switching section switches a heating mode between the first heating mode and the second heating mode. The first heating mode controls temperatures of the heating section and the pressurization section respectively at a first temperature and a second temperature to carry out a fixing processing. The second heating mode controls the temperature of the heating section at a temperature higher than the first temperature and the temperature of the pressurization section at a temperature lower than the second temperature to carry out a fixing processing. The control section switches the heating mode to the second heating mode through the switching section in a case in which the temperature of the heating section is lower than a predetermined temperature, and switches the heating mode to the first heating mode through the switching section in a case in which the temperature of the heating section is equal to or higher than the predetermined temperature.

Figure 1:
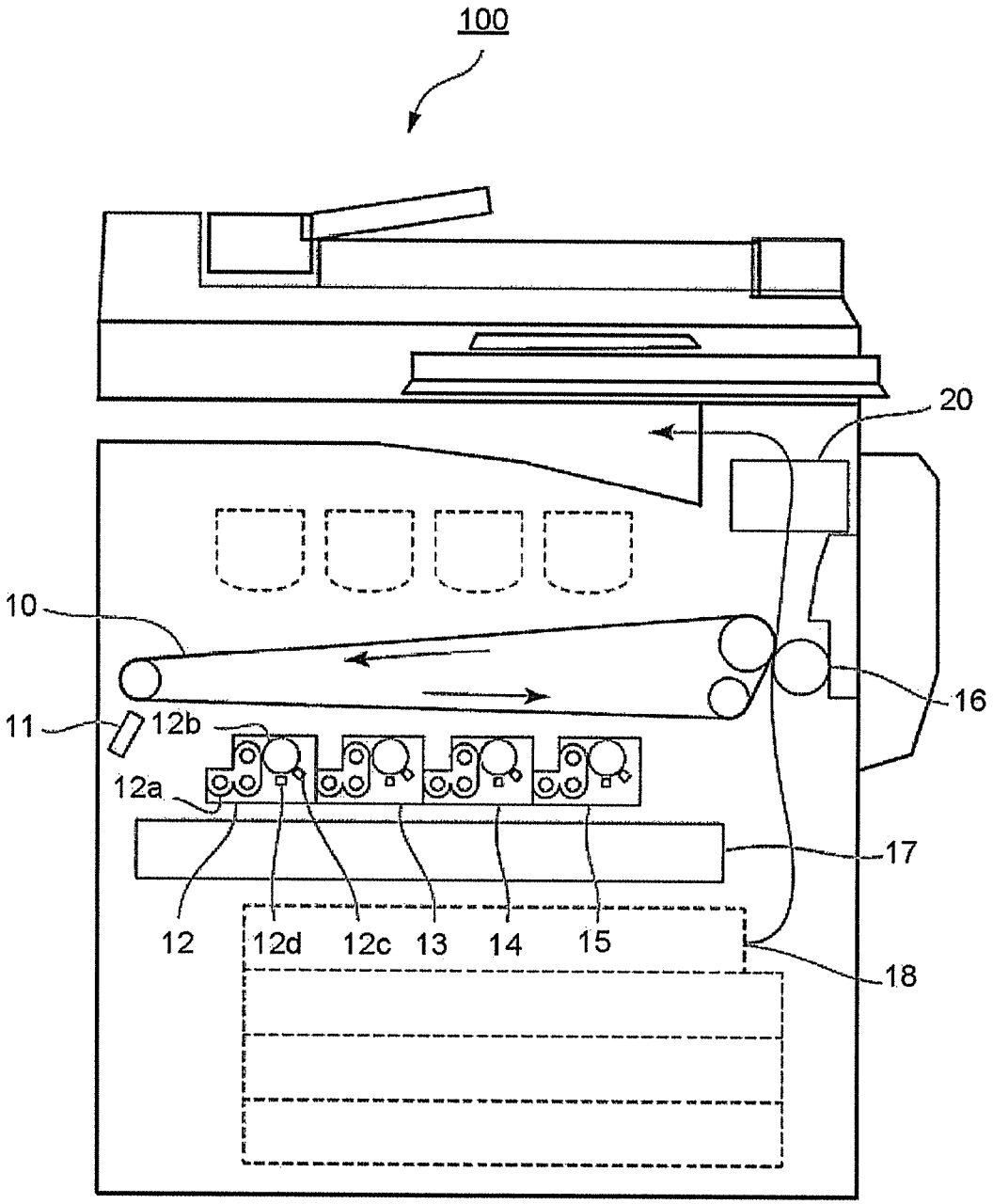
FIG. 1 is a diagram illustrating the schematic constitution of an image forming apparatus 100 according to an embodiment.

FIG. 1 is a diagram illustrating the schematic constitution of the image forming apparatus 100 according to the embodiment. The image forming apparatus 100 shown in FIG. 1 is an electrophotographic type image forming apparatus. The image forming apparatus 100 comprises an intermediate transfer body 10, a blade 11 (toner removing section), image forming sections 12~15, a secondary transfer roller 16, a control section 17, a sheet feeding section 18 and a fixing device 20.

In the present embodiment, the image forming apparatus 100 forms an electrostatic latent image on a photoconductive drum based on image information. Then, the image forming apparatus 100 enables the developing agent to adhere to the electrostatic latent image to form a visible image. As a concrete example of the developing agent, the toner may be listed.

The image forming apparatus 100 uses decolorable toner and non-decolorable toner as developing agent. The toner used as the decolorable developing agent has a decoloring function by being applied with energy from outside. "Applied with energy from outside" refers to an external stimulus such as temperature, light having a specific wavelength, pressure force is applied. The "decoloring" in the present embodiment means to make an image formed in a color (include not only chromatic color but also achromatic color such as white and black) different from the ground color of a paper invisible. In the following description, the toner used as the decolorable developing agent is described as decolorable toner. Further, the toner used as the non-decolorable developing agent is described as non-decolorable toner. Furthermore, in a case in which the decolorable toner and the non-decolorable toner are not specifically distinguished, they both are described as toner simply.

The intermediate transfer body 10, which is an endless belt, rotates in a direction indicated by an arrow shown in FIG. 1. The blade 11 removes the toner adhered to the intermediate transfer body 10.

The image forming sections 12-15 use toner of different colors (4 colors in the example shown in FIG. 1) to form images in different colors. The secondary transfer roller 16 transfers the image formed with toner on the intermediate transfer body 10 to a sheet.

The control section 17 controls the image forming sections 12-15 and the fixing device 20. The sheet feeding section 18 feeds sheets. The fixing device 20 heats and presses the toner image transferred to the sheet to fix it on the sheet.

The image forming apparatus 100 converts the formed image data into image data of each color through an image processing. For example, the image forming apparatus 100 converts the image data into image data of each color of yellow (Y), magenta (M), cyan (C) and black (K).

The image forming sections 12-15 carry out a multiple-transfer operation to overlap the toner images of various colors on the intermediate transfer body 10. Next, the secondary transfer roller 16 transfers the toner image on the intermediate transfer body 10 to the sheet.

The sheet is sent out from the sheet feeding section 18 and conveyed on a paper conveyance path. The sheet is discharged to a sheet discharge tray after passing through the secondary transfer roller 16 and the fixing device 20.

Next, the image forming sections 12-15 are described. The image forming section 12 forms a toner image with decolorable toner on a medium. The image forming sections 13, 14 and 15 form toner images with non-decolorable toner on the medium. Specifically, the image forming section 13 forms a yellow toner image on the medium. The image forming section 14 forms a magenta toner image on the medium. The image forming section 15 forms a cyan toner image on the medium.

Except one point that the housed developing agent is mutually different, the image forming sections 12-15 have identical constitutions, and thus only the image forming section 12 is described as an example.

The image forming section 12 is provided with a developing device 12*a*, a photoconductive drum 12*b*, a charging device 12*c* and an exposure section 12*d*.

The developing device 12*a* enables the toner to adhere to the photoconductive drum 12*b*. In a case of the image forming section 12, the developing device 12*a* houses the decolorable toner. Further, in a case of the image forming sections 13, 14 and 15, the developing devices house non-decolorable toner. In this way, the image forming apparatus 100 includes a first image forming section (the image forming section 12) which forms a toner image with decolorable toner on the medium. The image forming apparatus 100 further includes a second image forming section (each of the image forming sections 13, 14 and 15) which forms a toner image with non-decolorable toner on the medium.

The developing device 12*a* develops the toner image formed with decolorable toner. The photoconductive drum 12*b* is an image carrier. The photoconductive drum 12*b* is provided with a photoconductor (photosensitive area) on the outer peripheral surface thereof. For example, the photoconductor is an OPC (Organic Photo Conductor).

The charging device 12*c* charges the surface of the photoconductive drum 12*b* uniformly. The exposure section 12*d* irradiates the photoconductive drum 12*b* with light. The exposure section 12*d* is equipped with an exposure light source such as laser, LED and the like.

The photoconductive drum 12*b* is charged by the charging device 12*c*. Next, the exposure section 12*d* exposes the charged photoconductive drum 12*b* based on the image data of each kind of colors. In this way, electrostatic latent images are formed on the surface of the photoconductive drum 12*b*. The electrostatic latent images respectively correspond to the image data of each kind of colors. The electrostatic latent images on the surface of the photoconductive drum 12*b* are developed by the developing device 12*a*. That is, toner images are formed on the surface of the photoconductive drum 12*b*. The toner images on the surface of the photoconductive drum 12*b* are transferred onto the intermediate transfer body through an electric field.

Figure 2:
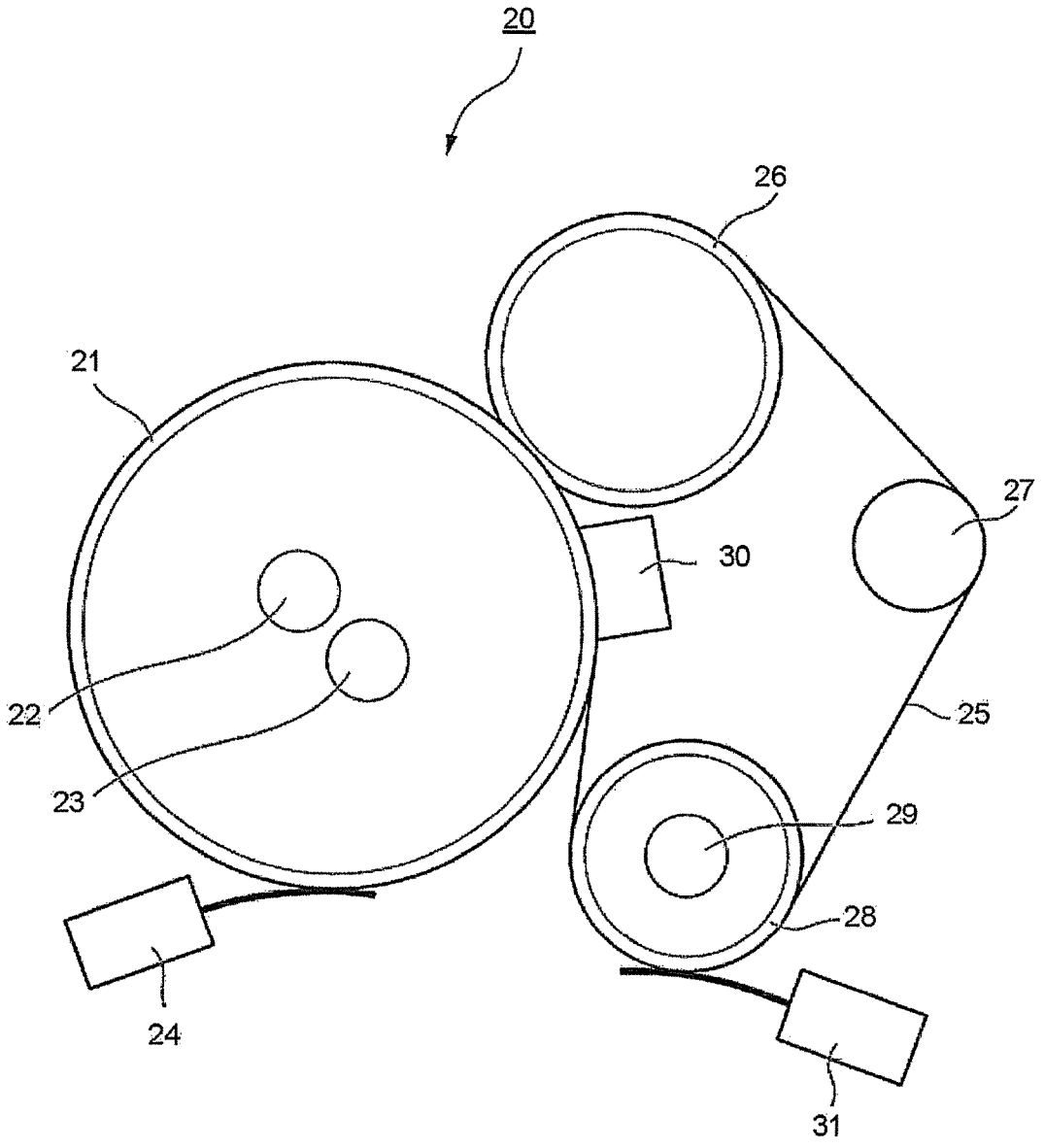
FIG. 2 is a cross-sectional view illustrating the schematic constitution of a fixing device 20.

FIG. 2 is a cross-sectional view illustrating the schematic constitution of the fixing device 20 shown in FIG. 1. The fixing device 20 comprises a heat roller (fixing roller) 21, an HR center lamp 22, an HR side lamp 23, an HR thermistor (fixing roller thermistor) 24, a pressurization belt 25, an outlet pressurization roller 26, a tension roller 27, a pressurization belt heat roller 28, a pressurization belt lamp 29, a nip pad 30 and a pressurization belt thermistor 31.

The heat roller 21 is a concrete example of a heating section. The heat roller 21 is heated by a heating element that is arranged therein. The heat roller 21 includes the HP center lamp 22 and the HP side lamp 23 therein. The HR center lamp 22 is a concrete example of a first heating element. The HR side lamp 23 is a concrete example of a second heating element.

For example, the HR center lamp 22 and the HR side lamp 23, for example, are heating sources such as a halogen lamp. Further, the power consumption of these two lamps, that is, the HR center lamp 22 and the HR side lamp 23 is 600 W.

The HR center lamp 22 heats the center part of the heat roller 21 in the longitudinal direction. The HR side lamp 23 heats the end part of the heat roller 21 in the longitudinal direction. The HR thermistor 24 detects the temperature of the heat roller 21.

The pressurization belt 25 is an endless belt. The pressurization belt 25 is supported and stretched by the outlet pressurization roller 26, the tension roller 27 and the pressurization belt heat roller 28.

The pressurization belt 25 is pressed by a pressurization mechanism (not shown), and thus a contact part of the heat roller 21 and the outlet pressurization roller 26 is pressed with a force of 290 "N". The tension roller 27 applies a tension force to the pressurization belt 25.

The pressurization belt heat roller 28 is heated by a heating element that is arranged therein. The pressurization belt heat roller 28 is a concrete example of a pressurization section. The pressurization belt heat roller 28 includes the pressurization belt lamp 29 therein as a heating element. The pressurization belt lamp 29 is a concrete example of a third heating element.

The pressurization belt lamp 29 heats the pressurization belt heat roller 28. The pressurization belt 25 is heated by the heat transmitted from the heated pressurization belt heat roller 28. For example, the pressurization belt lamp 29 is, for example, a heating source such as a halogen lamp. In the concrete example shown in FIG. 2, the pressurization belt lamp 29 is a halogen lamp of which the power consumption is 300 W.

The nip pad 30 presses the pressurization belt 25 from the inner side of the pressurization belt 25 against the outer peripheral surface of the heat roller 21 with an independent pressurization mechanism (not shown). In this way, the pressurization belt 25 is pressed against the heat roller 21.

The pressurization belt thermistor 31 detects the temperature of the pressurization belt 25. The pressurization belt thermistor 31 is arranged at a center part in the width direction of the pressurization belt 25.

The toner images on the sheet and the sheet are heated and pressed after passing through a nip between the heat roller 21 and the pressurization belt 25. The sheet passing through the nip is heated by both sides of the heat roller 21 and the pressurization belt 25. In this way, the toner image is fixed on the sheet.

Figure 3:
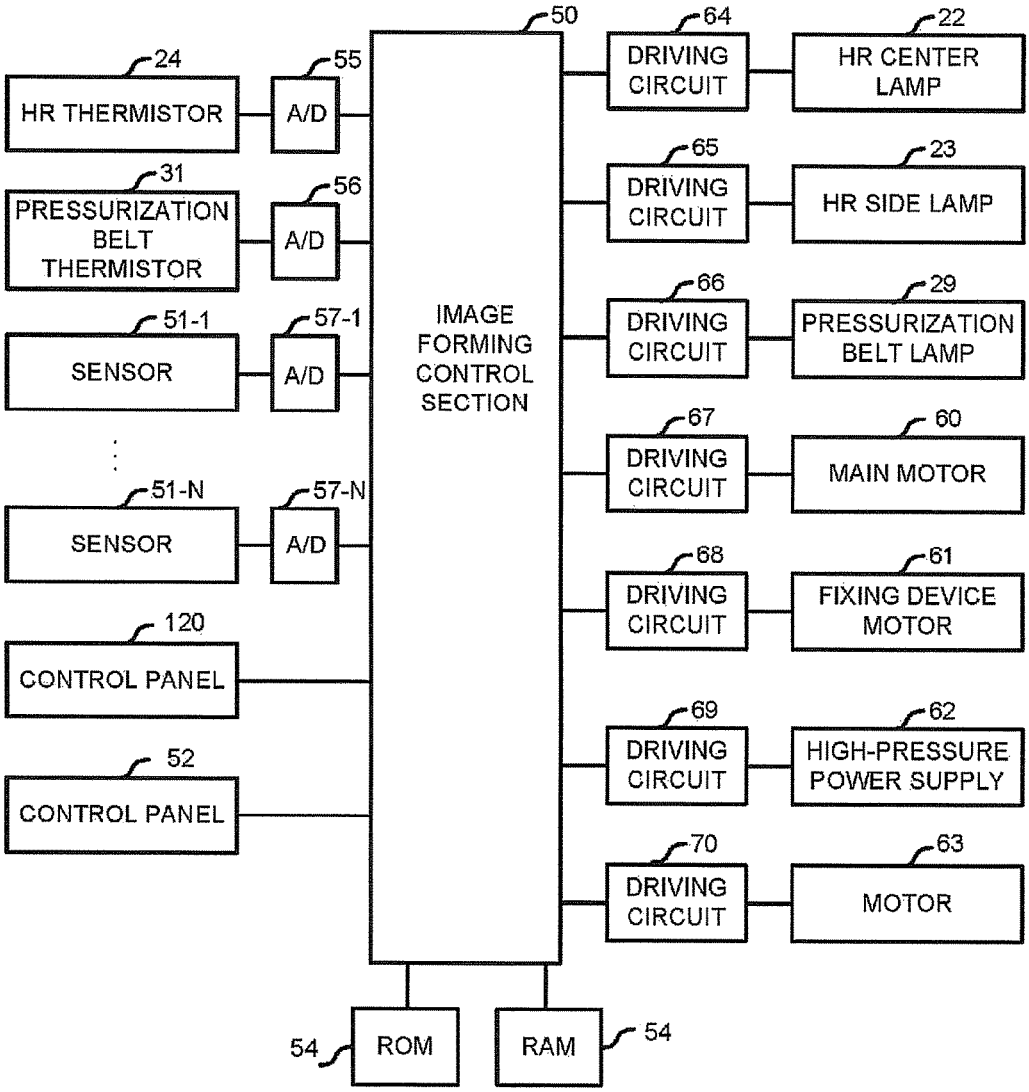
FIG. 3 is a block diagram illustrating the functional components of the image forming apparatus 100 according to the embodiment.

FIG. 3 is a block diagram illustrating the functional components of the image forming apparatus 100 according to the embodiment. In addition to a control panel 120, the HR center lamp 22, the HR side lamp 23, the HR thermistor 24, the pressurization belt lamp 29 and the pressurization belt thermistor 31, the image forming apparatus 100 further comprises an image forming control section 50, sensors 51-1~51-N (N is an integer equal to or greater than 1), a communication section 52, n ROM 53, a RAM 54, A/D (analog-digital) converters 55~56, A/D converters 57-1~57-N, a main motor 60, a fixing device motor 61, a high-pressure power supply 62, a motor 63, and driving circuits 64~70.

Hereinafter, any one of the sensors 51-1~51-N is simply represented as a sensor 51 when there is no need to distinguish that it is which one. Hereinafter, any one of the A/D converters 57-1~57-N is simply represented as an A/D converter 57 when there is no need to distinguish that it is which one.

The image forming control section 50 is provided with a CPU (Central Processing Unit). The image forming control section 50 controls the image forming apparatus including a temperature control of the fixing device 20.

The HR thermistor 24, the pressurization belt thermistor 31, the sensor 51, the control panel 120 and the communication section 52 are input devices connected to the image forming control section 50. The HR center lamp 22, the HR side lamp 23, the pressurization belt lamp 29, the main motor 60, the fixing device motor 61, the high-pressure power supply 62 and the motor 63 are output devices connected to the image forming control section 50.

First, the input devices connected to the image forming control section 50 are described below.

The HR thermistor 24 outputs a signal to the image forming control section 50 through the A/D converter 55. The HR thermistor 24 outputs a signal indicating the surface temperature of the heat roller 21 to the image forming control section 50.

The pressurization belt thermistor 31 outputs a signal to the image forming control section 50 through the A/D converter 56. The pressurization belt thermistor 31 outputs a signal indicating the surface temperature of the pressurization belt 25 to the image forming control section 50

The sensor 51 is used to measure the physical quantities that control image forming operations. The sensor 51 outputs a signal indicating the measured physical quantities to the image forming control section 50 through the A/D converter 57.

The control panel 120 outputs a signal indicating an instruction received from a user in the control panel 120 to the image forming control section 50. For example, the control panel 120 outputs a printing instruction given by the user. In this case, the image forming control section 50 forms an image based on the printing instruction given by the user.

The communication section 52 carries out a communication with an external device. The communication section 52 may carry out a wired communication or a wireless communication with the external device. For example, the external device is an information terminal such as a computer and the like. The communication section 52 receives the signal indicating an instruction given by the user from the external device, and then outputs the signal to the image forming control section 50.

Next, the output devices connected to the image forming control section 50 are described below.

The image forming control section 50 controls the operations of the HR center lamp 22 through the driving circuit 64. For example, the image forming control section 50 controls the lighting time of the HR center lamp 22 to control the temperature of the heat roller 21.

The image forming control section 50 controls the operations of the HR side lamp 23 through the driving circuit 65. For example, the image forming control section 50 controls the lighting time of the HR side lamp 23 to control the temperature of the heat roller 21. The image forming control section 50 may control the amount of power of the HR side lamp 23 to control the temperature of the heat roller 21.

The image forming control section 50 controls the operations of the pressurization belt lamp 29 through the driving circuit 66. For example, the image forming control section 50 controls the lighting time of the pressurization belt lamp 29 to control the temperature of the pressurization belt 25.

The image forming control section 50 controls the operations of the main motor 60 through the driving circuit 67. The image forming control section 50 controls the operations of the fixing device motor 61 through the driving circuit 68. The image forming control section 50 controls the operations of the high-pressure power supply 62 through the driving circuit 69. The image forming control section 50 controls the operations of the motor 63 through the driving circuit 70.

The driving circuits 64~70 are any of circuits such as a switching circuit, a D/A (digital-analog) converter and the like.

The main motor 60 drives each of the photoconductive drums of the image forming sections 12-15 such as the photoconductive drum 12*b* to rotate through a driving mechanism.

The fixing device motor 61 drives the heat roller 21 to rotate through a driving mechanism.

The high-pressure power supply 62 and the motor 63 carries out operations for forming an image. Though only one high-pressure power supply 62 and one motor 63 are shown in FIG. 3, the number of high-pressure power supplies 62 and the motors 63 may be more than one respectively.

The ROM 53 is connected to the image forming control section 50. The ROM 53 stores control programs and control data.

The RAM 54 is connected to the image forming control section 50. The RAM 54 stores operation data of the image forming apparatus 100 and control parameters. For example, the RAM 54 stores the number of prints of the counted consumables.

Figure 4:
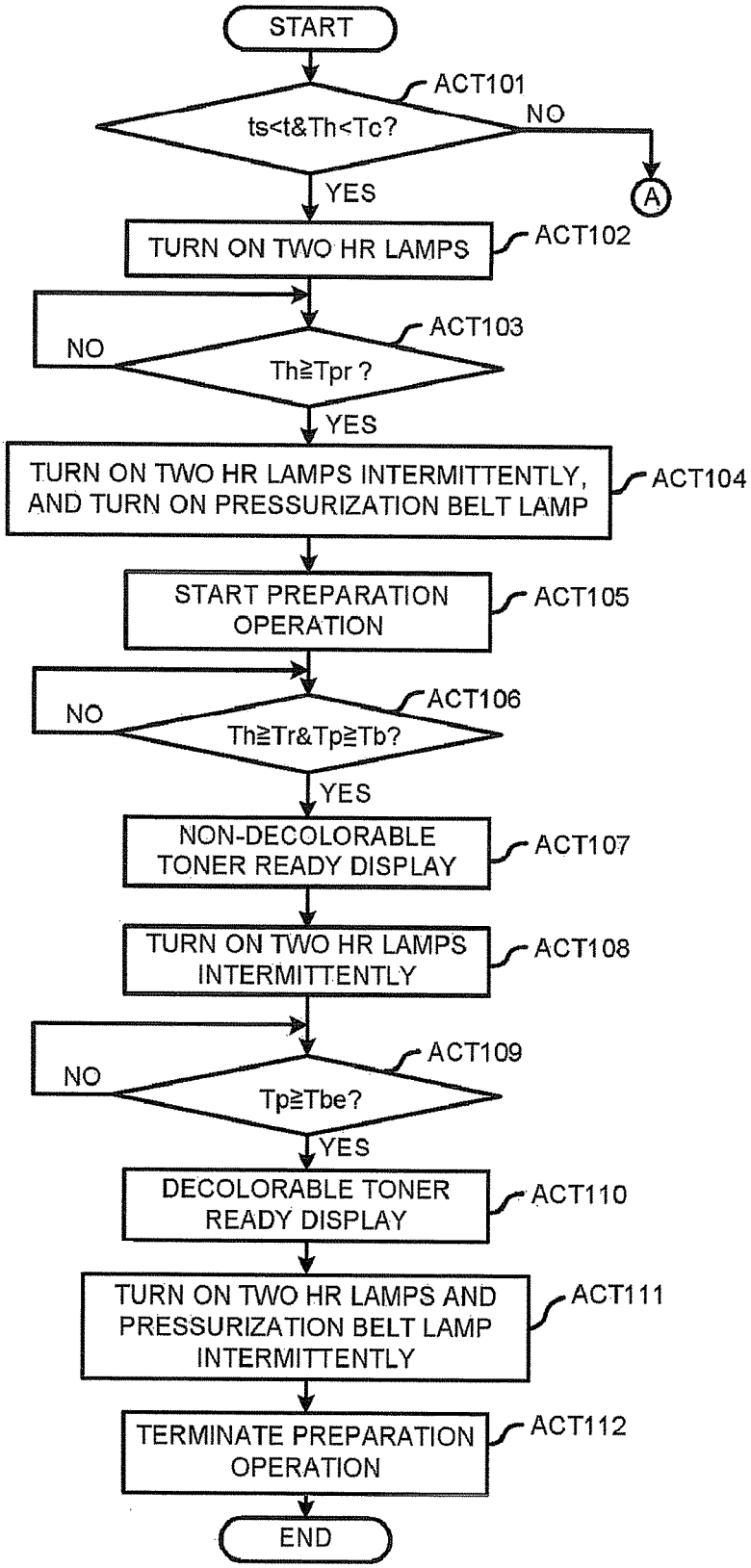
FIG. 4 is a diagram illustrating a warming-up processing.
Figure 5:
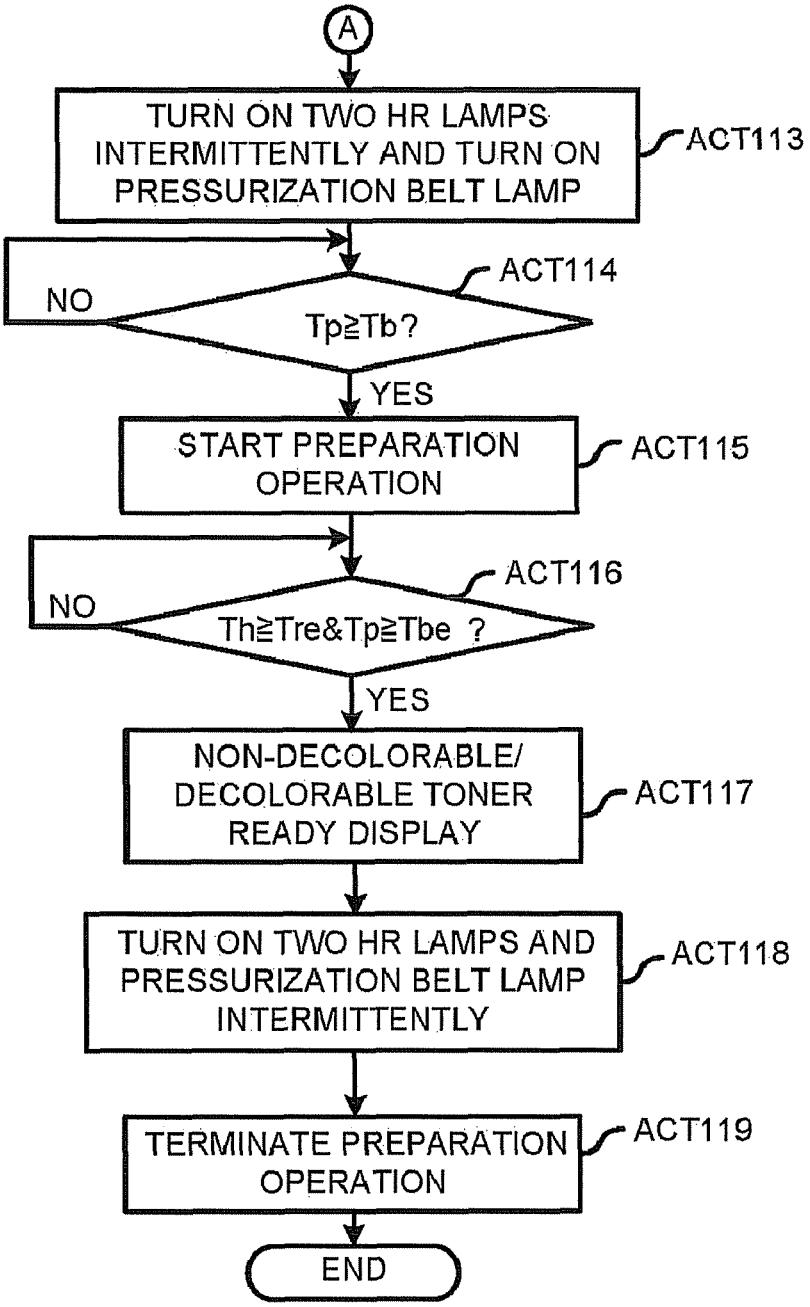
FIG. 5 is a diagram illustrating a warming-up processing.

FIG. 4 and FIG. 5 are diagrams illustrating a warming-up processing executed by the image forming apparatus 100 according to the embodiment. The image forming apparatus 100 starts the processing executed when a power supply is input to the image forming apparatus 100 or when the image forming apparatus 100 is restored from a power-saving state (hereinafter referred to as "sleep state"). The magnitude relation between the temperatures used in this flowchart is as follows.

$$Tc<Tb<Tbe<Tre<Tpr<Tr$$

Herein, Tc is a temperature used to determine whether the image forming control section 50 controls the heating mode to either of a first heating mode and a second heating mode when the image forming apparatus 100 is started or restored from the sleep state. The first heating mode is such a heating mode in which the temperatures of the heat roller 21 and the pressurization belt 25 are respectively controlled at a first temperature (Tre) and a second temperature (Tbe), and then a fixing processing is carried out. The second heating mode is such a heating mode in which the temperature of the heat roller 21 is controlled at a temperature (Tr) which is higher than the first temperature (Tre). The second heating mode is further such a heating mode in which the temperature of the pressurization belt 25 is controlled at a temperature (Tb) which is lower than the second temperature (Tbe) and then a fixing processing is carried out.

In a case in which the temperature of the pressurization belt 25 is Tbe and the temperature of the heat roller 21 is Tre, the image forming control section 50 is able to execute an image forming operation with non-decolorable toner. On the contrary, in a case in which the temperature of the pressurization belt 25 is Tb and the temperature of the heat roller 21 is Tr, the decolorable toner is decolored. Thus, an image forming operation cannot be carried out with decolorable toner.

Further, in a case in which the temperature of the pressurization belt 25 is Tbe and the temperature of the heat roller 21 is Tre, the image forming control section 50 is able to execute image forming operations with the non-decolorable toner and the decolorable toner.

In FIG. 4, the image forming control section 50 determines whether or not a sleep time t indicating an elapsed time from start to end of the sleep state is longer than a predetermined time ts, and whether or not a temperature Th of the heat roller 21 is lower than a given temperature Tc (ACT 101). Further, in a case in which the image forming apparatus 100 is started since the power supply is input, a determination on whether or not the sleep time t is longer than the predetermined time ts is not carried out. Through the processing in ACT 101, the heating mode can be switched between the first heating mode and the second heating mode. Further, through the switching operations according to the determination results in ACT 101, the image forming control section 50 controls the heating of the fixing device 20.

If YES is taken in ACT 101 (YES in ACT 101), the image forming control section 50 turns on both the HR center lamp 22 and the HR side lamp 23 (hereinafter referred to as "two HR lamps") (ACT 102). In this way, the heat roller 21 is heated.

After the two HR lamps are turned on, the image forming control section 50 determines whether or not the temperature Th of the heat roller 21 is higher than or equal to a preparation operation start temperature Tpr (ACT 103). The preparation operation is used to drive the heat roller 21 and the pressurization belt 25 to rotate.

If it is determined that the temperature Th of the heat roller 21 is higher than or equal to the preparation operation start temperature Tpr (YES in ACT 103), the image forming control section 50 carries out the following processing. That is, the image forming control section 50 turns on the two HR lamps intermittently, and turns on the pressurization belt lamp 29 (ACT 104). After the pressurization belt lamp 29 is turned on, the pressurization belt 25 is heated. Further, in the processing in ACT 104, the image forming control section 50 carries out an intermittent lighting operation in which the HR center lamp 22 and the HR side lamp 23 are turned on alternately. Next, the image forming control section 50 starts preparation operations (ACT 105).

The image forming control section 50 determines whether or not the temperature Th of the heat roller 21 is higher than or equal to the temperature Tr, and whether or not the temperature Tp of the pressurization belt 25 is higher than or equal to the temperature Tb (ACT 106). The temperature Tr and the temperature Tb are used to determine whether it is possible to execute an image forming processing with the non-decolorable toner.

If it is determined that the temperature Th of the heat roller 21 is higher than or equal to the temperature Tr, and the temperature Tp of the pressurization belt 25 is higher than or equal to the temperature Tb (YES in ACT 106), the image forming control section 50 carries out a non-decolorable toner ready display (ACT 107). Herein, for example, the image forming control section 50 displays information indicating that the image forming apparatus 100 is able to print with the non-decolorable toner on a display section 131.

The image forming control section 50 turns on the two HR lamps intermittently (ACT 108). In ACT 108, the image forming control section 50 carries out an intermittent lighting operation to further lower the heat value in a case in which the HR center lamp 22 and the HR side lamp 23 are turned on alternately, but not simultaneously. Through the intermittent lighting operation, the temperature Th of the heat roller 21 is gradually lowered.

The image forming control section 50 determines whether or not the temperature Tp of the pressurization belt 25 is higher than or equal to the temperature Tbe (ACT 109). If it is determined that the temperature Tp of the pressurization belt 25 is higher than or equal to the temperature Tbe (YES in ACT 109), the image forming control section 50 carries out a decolorable toner ready display (ACT 110). Herein, for example, the image forming control section 50 displays information indicating that the image forming apparatus 100 is able to print with the decolorable toner on the display section 131. In this way, the image forming apparatus 100 can print with either of the non-decolorable toner and the decolorable toner.

The image forming control section 50 turns on the two HR lamps and the pressurization belt lamp 29 intermittently (ACT 111). In ACT 111, the image forming control section 50 turns on the HR center lamp 22, the HR side lamp 23 and the pressurization belt lamp 29 intermittently but not simultaneously. Such an intermittent lighting operation is used to maintain the current temperatures of the heat roller 21 and the pressurization belt 25. The image forming control section 50 terminates the preparation operation (ACT 112), and then terminates the warming-up processing.

If NO is taken by the image forming control section 50 in the determination in ACT 101 (NO in ACT 101), the following processing shown in FIG. 5 is carried out. That is, the image forming control section 50 turns on the two HR lamps intermittently, and turns on the pressurization belt lamp 29 (ACT 113). In this way, in a case in which the temperature Th of the heat roller 21 is higher than or equal to the given temperature Tc, the image forming control section 50 switches the heating mode to the first heating mode. Further, in a case in which the time t spent in the sleep state is shorter than the predetermined time ts, the image forming control section 50 switches the heating mode to the first heating mode.

The pressurization belt lamp 29 is turned on to heat the pressurization belt 25. In ACT 113, the image forming control section 50 carries out the intermittent lighting operation in which the HR center lamp 22 and the HR side lamp 23 are turned on alternately.

The image forming control section 50 determines whether or not the temperature Tp of the pressurization belt 25 is higher than or equal to the temperature Tb (ACT 114). If it is determined that the temperature Tp of the pressurization belt 25 is higher than or equal to the temperature Tb (YES in ACT 114), the image forming control section 50 starts the preparation operation described above (ACT 115).

The image forming control section 50 determines whether or not the temperature Th of the heat roller 21 is higher than or equal to the temperature Tre, and whether or not the temperature Tp of the pressurization belt 25 is higher than or equal to the temperature Tbe (ACT 116).

If it is determined that the temperature Th of the heat roller 21 is higher than or equal to the temperature Tre, and the temperature Tp of the pressurization belt 25 is higher than or equal to the temperature Tbe (YES in ACT 116), the image forming control section 50 carries out decolorable/non-decolorable toner ready display (ACT 117). Herein, for example, the image forming control section 50 displays information indicating that the image forming apparatus 100 is able to print with non-decolorable toner and the decolorable toner on the display section 131. In this way, the image forming apparatus 100 can print with either of the non-decolorable toner and the decolorable toner.

The image forming control section 50 turns on the two HR lamps and the pressurization belt lamp 29 intermittently (ACT 118). In ACT 118, the image forming control section 50 turns on the HR center lamp 22, the HR side lamp 23 and the pressurization belt lamp 29 intermittently but not simultaneously. Such an intermittent lighting operation is carried out to maintain the current temperatures of the heat roller 21 and the pressurization belt 25. The image forming control section 50 terminates the preparation operation (ACT 119), and then terminates the warming-up processing.

In the processing in ACT 101 described above, the image forming control section 50 may carry out following control. That is, the image forming control section 50 may switch the heating mode to the first heating mode in a case in which the temperature Th of the heat roller 21 is higher than or equal to the given temperature Tc and the time t spent in the sleep state is shorter than the predetermined time ts.

Alternatively, the image forming control section 50 may switch the heating mode to the second heating mode in a case in which the temperature Th of the heat roller 21 is lower than the given temperature Tc, or the time t spent in the sleep state is longer than the predetermined time ts.

Figure 6:
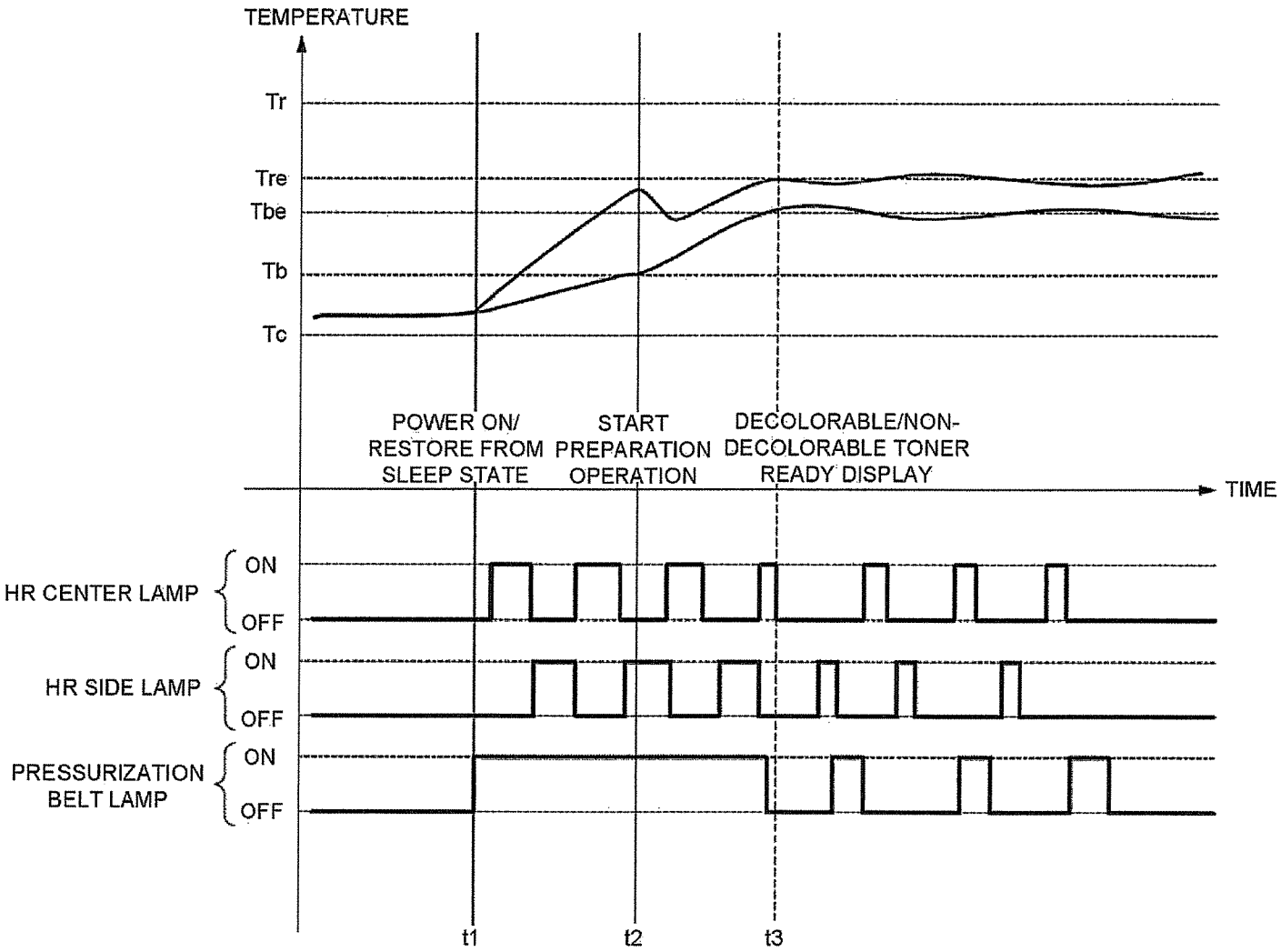
FIG. 6 is a diagram illustrating an example of operations in a first heating mode.

FIG. 6 is a diagram illustrating an example of operations in the first heating mode of the image forming apparatus 100 according to the embodiment.

FIG. 6 illustrates the temperature Th of the heat roller 21, the temperature Tp of the pressurization belt 25, the control on the HR center lamp 22, the control on the HR side lamp 23 and the control on the pressurization belt lamp 29.

First, at a timing t1, after the power supply is input to the image forming apparatus 100 or the image forming apparatus 100 is restored from the sleep state, since the temperature Th of the heat roller 21 is higher than or equal to the given temperature Tc (NO in ACT 101), the image forming control section 50 turns on the two HR lamps intermittently, and turns on the pressurization belt lamp 29 (ACT 113).

Next, at a timing t2, if the temperature Tp of the pressurization belt 25 is higher than or equal to the temperature Tb (YES in ACT 114), the image forming control section 50 starts the preparation operation (ACT 115). Then, at a timing t3, if the temperature Th of the heat roller 21 is higher than or equal to the temperature Tre and the temperature Tp of the pressurization belt 25 is higher than or equal to the temperature Tbe (YES in ACT 116), the image forming control section 50 carries out the decolorable/non-decolorable toner ready display (ACT 117). In this way, the image forming control section 50 controls the heating of the fixing device 20 in such a manner that the sum of power consumption does not exceed a given power consumption (for example, 900 W). The sum of power consumption refers to a sum of the power consumption of all of the HR center lamp 22, the HR side lamp 23 and the pressurization belt lamp 29.

Further, during a period the temperature of the heat roller 21 rises to the temperature Tre, the image forming control section 50 controls the HR center lamp 22 and the HR side lamp 23 to generate heat intermittently to not exceed the given power consumption.

If the temperatures of the heat roller 21 and the pressurization belt 25 become the temperature Tre and the temperature Tbe respectively, the image forming control section 50 controls the heat roller 21 and the pressurization belt 25 to make their power consumption not exceed the given power consumption. That is, the image forming control section 50 controls to enable the HR center lamp 22, the HR side lamp 23 and the pressurization belt lamp 29 to generate heat intermittently.

Figure 7:
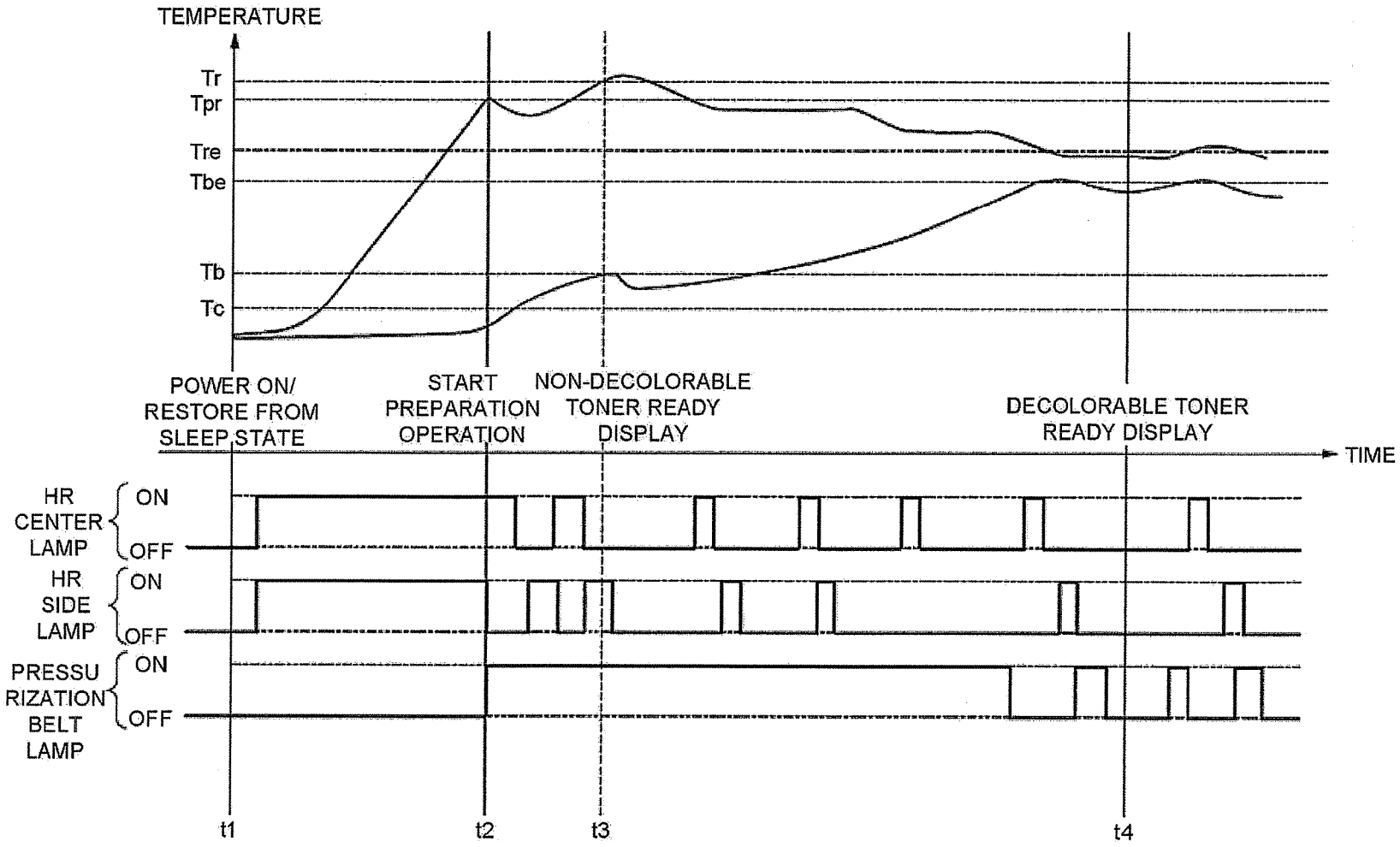
FIG. 7 is a diagram illustrating an example of operations in a second heating mode.

FIG. 7 is a diagram illustrating an example of operations in the second heating mode of the image forming apparatus 100.

FIG. 7 illustrates the temperature Th of the heat roller 21, the temperature Tp of the pressurization belt 25, the control on the HR center lamp 22, the control on the HR side lamp 23 and the control on the pressurization belt lamp 29. Further, it is assumed in the example of operations shown in FIG. 7 that the sleep time t is longer than the given time ts.

First, at a timing t1, after the power supply is input to the image forming apparatus 100 or the image forming apparatus 100 is restored from the sleep state, since the temperature Th of the heat roller 21 is lower than the given temperature Tc (YES in ACT 101), the image forming control section 50 turns on the two HR lamps (ACT 102).

Next, at a timing t2, if the temperature Th of the heat roller 21 is higher than or equal to the preparation operation start temperature Tpr (YES in ACT 103), the image forming control section 50 turns on the two HR lamps intermittently and turns on the pressurization belt lamp 29 (ACT 104). Sequentially, the image forming control section 50 starts the preparation operation (ACT 105).

At a timing t3, if the temperature Th of the heat roller 21 is higher than or equal to the temperature Tr and the temperature Tp of the pressurization belt 25 is higher than or equal to the temperature Tb (YES in ACT 106), the image forming control section 50 carries out the non-decolorable toner ready display (ACT 107).

At a timing t4, if the temperature Tp of the pressurization belt 25 is higher than or equal to the temperature Tbe (YES in ACT 109), the image forming control section 50 carries out a decolorable toner ready display (ACT 110). Then, the image forming control section 50 turns on the two HR lamps and the pressurization belt lamp 29 intermittently (ACT 111).

In the processing in ACT 101 described above, the image forming control section 50 may not carry out the determination on the sleep time t. That is, in the processing in ACT 101, the image forming control section 50 may only carry out the determination on the temperature Th of the heat roller 21.

In the embodiment described above, the HR center lamp 22 and the HR side lamp 23 each may heat the entire heat roller 21. The HR center lamp 22 and the HR side lamp 23 may respectively heat different parts of the heat roller 21.

Further, the HR thermistor 24 may be arranged at the center part and the side part of the heat roller 21.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

an image forming section configured to form a toner image on a medium;

a fixing section configured to include a heating section and a pressurization section, and to enable the medium on which the toner image is formed to pass a portion between the heating section and the pressurization section to fix the toner image on the medium;

a switching section configured to switch a heating mode between the first heating mode and the second heating mode, wherein under the first heating mode, the heating section and the pressurization section respectively are controlled at a first temperature and a second temperature to carry out a fixing processing, and under the second heating mode, the heating section is controlled at a temperature higher than the first temperature and the pressurization section is controlled at a temperature lower than the second temperature to carry out a fixing processing;

a control section configured to determine whether or not a sleep time t is longer than a predetermined time ts and to determine whether or not a temperature Th of a heat roller is lower than a given temperature Tc; and wherein the control section is further configured to switch the heating mode to the second heating mode through the switching section in a case in which the temperature of the heating section is lower than a predetermined temperature, and to switch the heating mode to the first heating mode through the switching section in a case in which the temperature of the heating section is equal to or higher than the predetermined temperature.

2. The image forming apparatus according to claim 1, wherein the image forming section includes a first image forming section which forms a toner image with decolorable toner on a medium and a second image forming section which forms a toner image with non-decolorable toner on a medium, fixes the toner images respectively formed by the first image forming section and the second image forming section on the medium in the first heating mode, and fixes the toner image formed by the first image forming section on the medium in the second heating mode.

3. The image forming apparatus according to claim 1, wherein the control section controls the heating of the fixing section by switching the heating mode to the first heating mode through the switching section in a case in which the temperature of the heating section is equal to or higher than the predetermined temperature, or the time spent in a power-saving state is shorter than a given time.

4. The image forming apparatus according to claim 1, wherein the control section controls the heating of the fixing section by switching the heating mode to the first heating mode through the switching section in a case in which the temperature of the heating section is higher than or equal to the predetermined temperature and the time spent in a power-saving state is shorter than a given time.

5. The image forming apparatus according to claim 1, wherein the control section controls the heating of the fixing section by switching the heating mode to the second heating mode through the switching section in a case in which the temperature of the heating section is lower than the predetermined temperature and the time spent in a power-saving state is longer than a given time.

6. The image forming apparatus according to claim 1, wherein the control section controls the heating of the fixing section by switching the heating mode to the second heating mode through the switching section in a case in which the temperature of the heating section is lower than the predetermined temperature, or the time spent in a power-saving state is longer than a given time.

7. The image forming apparatus according to claim 1, wherein the heating section is heated by a first heating element and a second heating element, and the pressurization section is heated by a third heating element.

8. The image forming apparatus according to claim 7, wherein the control section controls the first heating element, the second heating element and the third heating element to control the heating of the fixing section.

9. The image forming apparatus according to claim 8, wherein the control section controls the heating of the fixing section in such a manner that the sum of the power consumption of the first heating element, the power consumption of the second heating element and the power consumption of the third heating element does not exceed a given power consumption.

10. A control method for an image forming apparatus which comprises an image forming section configured to form a toner image on a medium, a fixing section configured to include a heating section and a pressurization section, and to enable the medium on which the toner image is formed to pass a portion between the heating section and the pressurization section to fix the toner image on the medium, including:

switching a heating mode between a first heating mode and a second heating mode, wherein temperatures of the heating section and the pressurization section are respectively controlled at a first temperature and the second temperature to carry out a fixing processing in the first heating mode, and the temperature of the heating section is controlled at a temperature higher than the first temperature and the temperature of the pressurization section is controlled at a temperature lower than the second temperature to carry out a fixing processing in the second heating mode; and controlling the heating of the fixing section by switching the heating mode to the second heating mode in a case in which the temperature of the heating section is lower than a predetermined temperature, and by switching the heating mode to the first heating mode in a case in which the temperature of the heating section is equal to or higher than the predetermined temperature.

* * * * *